US007354035B2

(12) United States Patent
Terao et al.

(10) Patent No.: US 7,354,035 B2
(45) Date of Patent: Apr. 8, 2008

(54) SHEET POST-PROCESS APPARATUS

(75) Inventors: Yasunobu Terao, Shizuoka-ken (JP); Reiji Murakami, Kanagawa-ken (JP); Tokihiko Ise, Shizuoka-ken (JP); Hajime Yamamoto, Shizuoka-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 250 days.

(21) Appl. No.: 11/085,242

(22) Filed: Mar. 22, 2005

(65) Prior Publication Data

US 2006/0078363 A1 Apr. 13, 2006

(30) Foreign Application Priority Data

Sep. 29, 2004 (JP) ..... 2004-285352
Dec. 17, 2004 (JP) ..... 2004-366523

(51) Int. Cl.
*B65H 37/04* (2006.01)

(52) U.S. Cl. ..... 270/58.11; 270/58.08; 270/58.09; 271/189; 271/190; 271/191; 271/192

(58) Field of Classification Search ..... 270/58.08, 270/58.09, 58.11; 271/189, 190, 191, 192
See application file for complete search history.

(56) References Cited

U.S. PATENT DOCUMENTS 4,473,425 A 9/1984 Baughman et al.
4,611,741 A 9/1986 Wilson
4,794,859 A 1/1989 Huseby et al.
4,849,796 A 7/1989 Murakami
4,898,374 A 2/1990 Vermaat
4,917,366 A 4/1990 Murakami et al.
5,020,784 A 6/1991 Asami et al.
5,021,837 A 6/1991 Uto et al.
5,098,074 A 3/1992 Mandel et al.
5,282,611 A 2/1994 Ueda et al.
5,285,249 A 2/1994 Mahoney
5,289,251 A 2/1994 Mandel et al.

(Continued)

FOREIGN PATENT DOCUMENTS

JP 61-078162 U 5/1986

(Continued)

OTHER PUBLICATIONS

Y. Terao et al., U.S. PTO Office Action, U.S. Appl. No. 11/008,131, filed Oct. 17, 2006, 15 pages.

(Continued)

*Primary Examiner*—Gene O. Crawford
*Assistant Examiner*—Leslie A Nicholson, III
(74) *Attorney, Agent, or Firm*—Foley & Lardner LLP

(57) ABSTRACT

In a sheet post-process apparatus of the present invention, a processing tray for loading sheets of paper fed via a standby tray for making ejected sheets of paper stand by or not via the standby tray and a standby tray roller for performing a first operation of making contact with sheets of paper loaded on the standby tray and matching and a second operation of making contact with sheets of paper loaded on the standby tray and conveying them toward a paper ejection tray are installed in the neighborhood of the standby tray.

7 Claims, 11 Drawing Sheets

U.S. PATENT DOCUMENTS

| | | | | |
|---|---|---|---|---|
| 5,337,134 | A | 8/1994 | Sato et al. | |
| 5,370,384 | A | 12/1994 | Romanowski | |
| 5,418,606 | A | 5/1995 | Kikuchi et al. | |
| 5,435,544 | A | 7/1995 | Mandel | |
| 5,449,157 | A | 9/1995 | Kawano et al. | |
| 5,451,037 | A | 9/1995 | Lundstrom | |
| 5,590,871 | A | 1/1997 | Okabe et al. | |
| 5,622,359 | A | 4/1997 | Kawano et al. | |
| 5,628,502 | A | 5/1997 | Amarakoon | |
| 5,640,232 | A | 6/1997 | Miyake et al. | |
| 5,676,517 | A | 10/1997 | Lotz | |
| 5,709,376 | A | 1/1998 | Ushirogata | |
| 5,767,884 | A | 6/1998 | Bortolotti et al. | |
| 5,934,140 | A | 8/1999 | Jackson et al. | |
| 5,961,274 | A | 10/1999 | Bors | |
| 5,971,384 | A | 10/1999 | Asao | |
| 6,022,011 | A | 2/2000 | Hirose | |
| 6,065,747 | A | 5/2000 | Khovaylo et al. | |
| 6,092,948 | A | 7/2000 | Altfather | |
| 6,102,385 | A | 8/2000 | Wakamatsu et al. | |
| 6,120,020 | A | 9/2000 | Asao | |
| 6,142,461 | A | 11/2000 | Asao et al. | |
| 6,145,828 | A | 11/2000 | Arai | |
| 6,146,085 | A | 11/2000 | Namba et al. | |
| 6,179,287 | B1 | 1/2001 | Watanabe et al. | |
| 6,231,039 | B1 | 5/2001 | Chung | |
| 6,330,999 | B2 * | 12/2001 | Coombs et al. | 270/58.18 |
| 6,336,630 | B1 | 1/2002 | Holtman et al. | |
| 6,354,059 | B1 | 3/2002 | Yoshie et al. | |
| 6,357,753 | B1 | 3/2002 | Yamasaki et al. | |
| 6,371,472 | B1 | 4/2002 | Miyake et al. | |
| 6,450,934 | B1 | 9/2002 | Coombs | |
| 6,505,829 | B2 | 1/2003 | Kawata | |
| 6,581,922 | B2 | 6/2003 | Kuwata et al. | |
| 6,600,885 | B2 | 7/2003 | Kida | |
| 6,641,129 | B2 | 11/2003 | Ogita et al. | |
| 6,659,455 | B2 | 12/2003 | Endo et al. | |
| 6,671,492 | B2 | 12/2003 | Mimura et al. | |
| 6,674,983 | B2 | 1/2004 | Enomoto et al. | |
| 6,698,744 | B2 | 3/2004 | Yamada et al. | |
| 6,712,349 | B2 | 3/2004 | Watanabe | |
| 6,722,646 | B2 | 4/2004 | Sekiyama et al. | |
| 6,722,650 | B1 | 4/2004 | Abbata et al. | |
| 6,733,006 | B2 | 5/2004 | Kobayashi et al. | |
| 6,733,007 | B2 | 5/2004 | Sekiyama et al. | |
| 6,767,012 | B2 | 7/2004 | Sasamoto | |
| 6,819,906 | B1 | 11/2004 | Herrmann et al. | |
| 6,824,128 | B2 | 11/2004 | Nagata et al. | |
| 6,848,685 | B2 | 2/2005 | Katsuyama | |
| 6,871,042 | B2 | 3/2005 | Nemura et al. | |
| 6,910,686 | B2 | 6/2005 | Awano | |
| 6,928,259 | B2 | 8/2005 | Sakuma | |
| 6,988,728 | B2 | 1/2006 | Kida | |
| 7,104,538 | B1 | 9/2006 | Kimura et al. | |
| 2002/0047233 | A1 | 4/2002 | Coombs et al. | |
| 2002/0053766 | A1 | 5/2002 | Kubota | |
| 2002/0074708 | A1 | 6/2002 | Nagata et al. | |
| 2002/0163119 | A1 | 11/2002 | Kawata | |
| 2003/0057625 | A1 | 3/2003 | Kuwata et al. | |
| 2003/0155705 | A1 | 8/2003 | Sekiyama et al. | |
| 2003/0214090 | A1 | 11/2003 | Kato et al. | |
| 2004/0032073 | A1 | 2/2004 | Sasamoto | |
| 2004/0113348 | A1 | 6/2004 | Awano | |
| 2004/0126163 | A1 | 7/2004 | Asami et al. | |
| 2004/0181308 | A1 | 9/2004 | Hayashi et al. | |
| 2005/0000336 | A1 | 1/2005 | Hattori et al. | |

FOREIGN PATENT DOCUMENTS

| | | | |
|---|---|---|---|
| JP | 62-008965 | A | 1/1987 |
| JP | 63-035756 | U | 3/1988 |
| JP | 63-180673 | A | 7/1988 |
| JP | 02-055369 | A | 2/1990 |
| JP | 03-088667 | A | 4/1991 |
| JP | 04-079857 | U | 7/1992 |
| JP | 04-312894 | A | 11/1992 |
| JP | 04-354756 | A | 12/1992 |
| JP | 05-238103 | A | 9/1993 |
| JP | 08-259073 | A | 10/1996 |
| JP | 09-309659 | A | 12/1997 |
| JP | 10-095563 | A | 4/1998 |
| JP | 10-279169 | A | 10/1998 |
| JP | 10-324449 | A | 12/1998 |
| JP | 11-011786 | A | 1/1999 |
| JP | 11-043257 | A | 2/1999 |
| JP | 11-147641 | A | 6/1999 |
| JP | 11-208967 | A | 8/1999 |
| JP | 11-231753 | A | 8/1999 |
| JP | 11-301912 | A | 11/1999 |
| JP | 2000-095420 | A | 4/2000 |
| JP | 2000-159414 | A | 6/2000 |
| JP | 2001-048411 | A | 2/2001 |
| JP | 2001-089009 | A | 4/2001 |
| JP | 2001-316029 | A | 11/2001 |
| JP | 2002-060118 | A | 2/2002 |
| JP | 2002-308509 | A | 10/2002 |
| JP | 2003-081517 | A | 3/2003 |
| JP | 2003-171057 | A | 6/2003 |
| JP | 2003-192210 | A | 7/2003 |
| JP | 2003-246536 | A | 9/2003 |
| JP | 2003-335450 | A | 11/2003 |
| JP | 2004-142868 | A | 5/2004 |
| JP | 2004-155551 | A | 6/2004 |

OTHER PUBLICATIONS

Y. Terao et al., U.S. PTO Office Action, U.S. Appl. No. 11/008,132, filed Nov. 24, 2006, 16 pages.
Y. Terao et al., U.S. PTO Office Action, U.S. Appl. No. 11/008,224, filed Nov. 17, 2006, 13 pages.
Y. Terao et al., U.S. PTO Office Action, U.S. Appl. No. 11/008,230, filed Nov. 13, 2006, 17 pages.
Y. Terao et al., U.S. PTO Office Action, U.S. Appl. No. 11/008,294, filed Oct. 24, 2006, 11 pages.
Y. Terao et al., U.S. PTO Office Action, U.S. Appl. No. 11/085,625, filed Nov. 21, 2006, 13 pages.
Y. Terao, et al., Notice of Allowance and Fee(s) Due, U.S. Appl. No. 11/008,257, filed Oct. 24, 2006, 11 pages.
Y. Terao et al., Notice of Allowance and Fee(s) Due, U.S. Appl. No. 11/008,295, filed Sep. 21, 2006, 7 pages.
Y. Terao et al., Notice of Allowance and Fee(s) Due, U.S. Appl. No. 11/008,350, filed Sep. 21, 2006, 7 pages.
Y. Terao et al., Notice of Allowance and Fee(s) Due, U.S. Appl. No. 11/008,392, filed Sep. 15, 2006, 10 pages.
Y. Terao et al., U.S. PTO Office Action , U.S. Appl. No. 11/008,381, filed Aug. 23, 2006, 17 pages.
Y. Terao et al., U.S. PTO Office Action , U.S. Appl. No. 11/008,567, filed Aug. 21, 2006, 14 pages.
Y. Terao, et al., Notice of Allowance and Fee(s) Due, U.S. Appl. No. 11/008,222, filed Aug. 31, 2006, 12 pages.
Y. Terao, et al., Notice of Allowance and Fee(s) Due, U.S. Appl. No. 11/008,299, filed Sep. 6, 2006, 9 pages.
Y. Terao et al., Notice of Allowance and Fee(s) Due, U.S. Appl. No. 11/085,244, filed Jul. 13, 2006, 10 pages.
Y. Terao et al., U.S. PTO Office Action, U.S. Appl. No. 11/008,145, filed Jun. 30, 2006, 6 pgs.
Y. Terao et al., U.S. PTO Office Action, U.S. Appl. No. 11/008,147, filed Jul. 7, 2006, 4 pgs.
Y. Terao et al., U.S. PTO Office Action, U.S. Appl. No. 11/008,290, filed Jul. 21, 2006, 15 pgs.
Y. Terao et al., U.S. PTO Office Action, U.S. Appl. No. 11/008,350, filed Jul. 6, 2006, 12 pgs.
Y. Terao et al., U.S. PTO Office Action, U.S. Appl. No. 11/085,226, filed Jul. 20, 2006, 12 pages.

Y. Terao et al., U.S. PTO Office Action, U.S. Appl. No. 11/085,227, filed Aug. 11, 2006, 15 pages.
Y. Terao et al., U.S. PTO Office Action, U.S. Appl. No. 11/085,240, filed Aug. 2, 2006, 15 pages.
Y. Terao et al., U.S. PTO Office Action, U.S. Appl. No. 11/085,247, filed Jul. 13, 2006, 14 pgs.
Y. Terao et al., U.S. PTO Office Action, U.S. Appl. No. 11/085,248, filed Jul. 5, 2006, 15 pgs.
Y. Terao et al., U.S. PTO Office Action, U.S. Appl. No. 11/085,256, filed Jul. 13, 2006, 13 pgs.
Y. Terao et al., U.S. PTO Office Action, U.S. Appl. No. 11/085,625, filed Jul. 28, 2006, 13 pgs.
Y. Terao, et al., Notice of Allowance and Fee(s) Due, U.S. Appl. No. 11/008,122, filed Jul. 26, 2006, 8 pgs.
Y. Terao et al., Notice of Allowance and Fee(s) Due, U.S. Appl. No. 11/008,148, filed Jun. 26, 2006, 10 pages.
Y. Terao et al., Notice of Allowance and Fee(s) Due, U.S. Appl. No. 11/008,251, filed Jun. 26, 2006, 10 pages.
Y. Terao et al., Notice of Allowance and Fee(s) Due, U.S. Appl. No. 11/085,241, filed Jun. 26, 2006, 10 pages.
Y. Terao et al., Notice of Allowance and Fee(s) Due, U.S. Appl. No. 11/085,243, filed Jun. 26, 2006, 10 pages.
Y. Terao et al., U.S. PTO Office Action, U.S. Appl. No. 11/008,132, filed Jun. 9, 2006, with attached Notice of Withdrawal from Issue dated May 30, 2006, 11 pages.
Y. Terao et al., U.S. PTO Office Action, U.S. Appl. No. 11/008,295, filed Jun. 23, 2006, 14 pages.
K. Sasahara et al., U.S. PTO Office Action, U.S. Appl. No. 11/008,122, filed Apr. 19, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,349, filed May 2, 2005, 9 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,271, filed Apr. 25, 2006, 14 pages.
Y. Terao et al., U.S. PTO Office Action, U.S. Appl. No. 11/008,294, filed May 5, 2006 13 pages.
Y. Terao et al., U.S. PTO Office Action, U.S. Appl. No. 11/008,299, filed May 5, 2006, 12 pages.
Y. Terao et al., U.S. PTO Office Action, U.S. Appl. No. 11/008,392, filed Apr 26, 2006, 10 pages.
U.S. Appl. No. 11/008,122, filed Dec. 10, 2004, Sasahara.
U.S. Appl. No. 11/008,567, filed Dec. 10, 2004, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
Y. Terao et al., Notice of Allowance and Fee(s) Due, U.S. Appl. No. 11/008,132, filed Oct. 6, 2005, 9 pages.
Y. Terao et al., U.S. PTO Notice of Allowance, U.S. Appl. No. 11/085,243, filed Jan. 5, 2006, with attached Notice of Withdrawal from Issue dated Jan. 10, 2006, 10 pages.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,148, filed Jan. 11, 2006, 12 pages.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,224, filed Nov. 21, 2005, 9 pages.
Y. Terao et al., U.S. PTO Office Action, U.S. Appl. No. 11/008,230, filed Feb. 24, 2006, 11 pgs.
Y. Terao et al., U.S. PTO Office Action, U.S. Appl. No. 11/008,251, filed Jan. 13, 2006, 11 pages.
Y. Terao et al., U.S. PTO Office Action, U.S. Appl. No. 11/008,257, filed Nov. 30, 2005, 9 pages.
Y. Terao et al., U.S. PTO Office Action, U.S. Appl. No. 11/008,271, filed Nov. 30, 2005, 9 pages.
Y. Terao et al., U.S. PTO Office Action, U.S. Appl. No. 11/008,290, filed Nov. 30, 2005, 9 pages.
Y. Terao et al., U.S. PTO Office Action, U.S. Appl. No. 11/008,295, filed Jan. 5, 2006, 11 pages.
Y. Terao et al., U.S. PTO Office Action, U.S. Appl. No. 11/008,350, filed Jan. 26, 2006, 12 pages.
Y. Terao et al., U.S. PTO Office Action, U.S. Appl. No. 11/008,392, filed Dec. 14, 2005, 9 pages.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,240, filed Jan. 26, 2006, 8 pgs.
Y. Terao et al., U.S. PTO Office Action, U.S. Appl. No. 11/085,241, filed Feb. 9, 2006, 9 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 9, 2006, 7 pgs.
Y. Terao et al., U.S. PTO Office Action, U.S. Appl. No. 11/008,294, filed Dec. 13, 2005, 9 pages.
Y. Terao et al., U.S. PTO Office Action, U.S. Appl. No. 11/008,299, filed Dec. 13, 2005, 9 pages.
Y. Terao et al., U.S. PTO Office Action, U.S. Appl. No. 11/008,349, filed Dec. 13, 2005, 9 pages.
Y. Terao et al., U.S. PTO Office Action, U.S. Appl. No. 11/008,567, filed Dec. 13, 2005, 9 pages.
Y. Terao, et al., Notice of Allowance and Fee(s) Due, U.S. Appl. No. 11/008,124, filed Sep. 30, 2005, 9 pages.
U.S. Appl. No. 11/085,247, filed Mar. 22, 2005, Terao et al.
U.S. Appl. No. 11/085,226, filed Mar. 22, 2005, Terao et al.
U.S. Appl. No. 11/085,248, filed Mar. 22, 2005, Terao et al.
U.S. Appl. No. 11/085,227, filed Mar. 22, 2005, Terao et al.
U.S. Appl. No. 11/085,244, filed Mar. 22, 2005, Terao et al.
U.S. Appl. No. 11/085,243, filed Mar. 22, 2005, Terao et al.
U.S. Appl. No. 11/085,240, filed Mar. 22, 2005, Terao et al.
U.S. Appl. No. 11/085,250, filed Mar. 22, 2005, Terao et al.
U.S. Appl. No. 11/085,241, filed Mar. 22, 2005, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,222, filed Dec. 10, 2004, Terao et al.
U.S. Appl. No. 11/008,381, filed Dec. 10, 2004, Terao et al.
U.S. Appl. No. 11/008,132, filed Dec. 10, 2004, Terao et al.
U.S. Appl. No. 11/008,131, filed Dec. 10, 2004, Terao et al.
U.S. Appl. No. 11/008,142, filed Dec. 10, 2004, Terao et al.
U.S. Appl. No. 11/008,199, filed Dec. 10, 2004, Terao et al.
U.S. Appl. No. 11/008,145, filed Dec. 10, 2004, Terao et al.
U.S. Appl. No. 11/008,124, filed Dec. 10, 2004, Terao et al.
U.S. Appl. No. 11/008,350, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,349, filed Dec. 10, 2004, Terao et al.
U.S. Appl. No. 11/008,294, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,290, filed Dec. 10, 2004, Terao et al.
U.S. Appl. No. 11/008,392, filed Dec. 10, 2004, Terao et al.
U.S. Appl. No. 11/008,299, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,295, filed Dec. 10, 2004, Terao et al.
U.S. Appl. No. 11/008,251, filed Dec. 10, 2004, Terao et al.
Y. Terao et al., Notice of Allowance and Fee(s) Due, U.S. Appl. No. 11/008,294, filed Feb. 6, 2007, 7 pages.
Y. Terao et al., Notice of Allowance and Fee(s) Due, U.S. Appl. No. 11/008,381, filed Feb. 22, 2007, 23 pages.
Y. Terao et al., Notice of Allowance and Fee(s) Due, U.S. Appl. No. 11/008,567, filed Mar. 1, 2007, 6 pages.

Y. Terao et al., Notice of Allowance and Fee(s) Due, U.S. Appl. No. 11/085,247, filed Feb. 28, 2007, 14 pages.
Y. Terao et al., U.S. PTO Office Action, U.S. Appl. No. 11/008,131, filed Feb. 8, 2007, 22 pages.
Y. Terao et al., U.S. PTO Office Action, U.S. Appl. No. 11/008,224, filed Feb. 28, 2007, 11 pages.
Y. Terao et al., U.S. PTO Office Action, U.S. Appl. No. 11/085,226, filed Jan. 29, 2007, 6 pages.
Y. Terao et al., U.S. PTO Office, U.S. Appl. No. 11/008,290, filed Mar. 9, 2007, 8 pages.
Y. Terao et al., U.S. PTO Office, U.S. Appl. No. 11/085,240, filed Mar. 12, 2007, 15 pages.
Y. Terao et al., U.S. PTO Office, U.S. Appl. No. 11/085,248, filed Apr. 10, 2007, 12 pages.
Y. Terao et al., U.S. PTO Office, U.S. Appl. No. 11/085,257, filed Mar. 23, 2007, 23 pages.
Y. Terao et al., U.S. PTO Office, U.S. Appl. No. 11/085,264, filed Mar. 23, 2007, 21 pages.
C. Iizuka et al., U.S. PTO Office Action, U.S. Appl. No. 11/085,251, filed Jun. 25, 2007, 28 pgs.
Y. Terao et al., Notice of Allowance and Fee(s) Due, U.S. Appl. No. 11/008,132, filed Jun. 1, 2007, 11 pgs.
Y. Terao et al., Notice of Allowance and Fee(s) Due, U.S. Appl. No. 11/008,294, filed Jun. 14, 2007, 6 pgs.
Y. Terao et al., Notice of Allowance and Fee(s) Due, U.S. Appl. No. 11/008,381, filed Jun. 29, 2007, 6 pgs.
Y. Terao et al., U.S. PTO Office Action, U.S. Appl. No. 11/085,250, filed Jun. 20, 2007, 24 pgs.
Y. Terao et al., U.S. PTO Office Action, U.S. Appl. No. 11/085,625, filed Jul. 10, 2007, 11 pgs.
Y. Terao et al., Notice of Allowance and Fee(s) Due, U.S. Appl. No. 11/008,290, filed Aug. 2, 2007, 9 pages.
Y. Terao et al., Notice of Allowance and Fee(s) Due, U.S. Appl. No. 11/008,299, filed Jul. 23, 2007, 10 pages.
Y. Terao et al., Notice of Allowance and Fee(s) Due, U.S. Appl. No. 11/085,240, filed Jul. 24, 2007, 20 pages.
Y. Terao et al., Notice of Allowance and Fee(s) Due, U.S. Appl. No. 11/085,248, filed Aug. 16, 2007, 8 pages.
Y. Terao et al., U.S. PTO Office Action, U.S. Appl. No. 11/085,257, filed Jul. 16, 2007, 12 pages.
Y. Terao et al., Notice of Allowance and Fee(s) Due, U.S. Appl. No. 11/008,131, filed Sep. 26, 2007, 12 pages.
Y. Terao et al., U.S. PTO Office Action, U.S. Appl. No. 11/008,199, filed Aug. 30, 2007, 18 pages.
Y. Terao et al., U.S. PTO Office Action, U.S. Appl. No. 11/008,244, filed Aug. 28, 2007, 8 pages.
Y. Terao et al., U.S. PTO Office Action, U.S. Appl. No. 11/008,248, filed Aug. 22, 2007, 8 pgs.
Y. Terao et al., Notice of Allowance and Fee(s) Due, U.S. Appl. No. 11/085,264, filed Sep. 12, 2007, 16 pages.
Y. Terao et al., U.S. PTO Office Action, U.S. Appl. No. 11/822,611, filed Sep. 25, 2007, 20 pages.
Y. Terao et al., U.S. PTO Office Action, U.S. Appl. No. 11/826,731, filed Sep. 13, 2007, 21 pages.
Y. Terao et al., Notice of Allowance and Fee(s) Due, U.S. Appl. No. 11/008,142, filed Jan. 5, 2007, 24 pages.
Y. Terao et al., Notice of Allowance and Fee(s) Due, U.S. Appl. No. 11/008,145, filed Dec. 14, 2006, 20 pages.
Y. Terao et al., Notice of Allowance and Fee(s) Due, U.S. Appl. No. 11/008,147, filed Nov. 17, 2006, 7 pages.
Y. Terao et al., U.S. PTO Office Action, U.S. Appl. No. 11/008,248, filed Jan. 8, 2007, 25 pgs.
Y. Terao et al., U.S. PTO Office Action, U.S. Appl. No. 11/085,248, filed Oct. 24, 2006, 12 pages.
Y. Terao et al., Notice of Allowance and Fee(s) Due, U.S. Appl. No. 11/008,132, Oct. 6, 2005, 9 pages.
Y. Terao et al., U.S. PTO Notice of Allowance, U.S. Appl. No. 11/085, 243, Jan. 5, 2006, with attached Notice of Withdrawal from Issue dated Jan. 10, 2006, 10 pgs.
Y. Terao et al., U.S. PTO Office Action, U.S. Appl. No. 11/008,122, Nov. 21, 2005, 9 pages.
Y. Terao et al., U.S. PTO Office Action, U.S. Appl. No. 11/008,131, Feb. 23, 2006, 9 pgs.
Y. Terao et al., U.S. PTO Office Action, U.S. Appl. No. 11/008,148, Jan. 11, 2006, 12 pages.
Y. Terao et al., U.S. PTO Office Action, U.S. Appl. No. 11/008,222, Feb. 24, 2006, 12 pgs.
Y. Terao et al., U.S. PTO Office Action, U.S. Appl. No. 11/008,224, Nov. 21, 2005, 9 pages.
Y. Terao et al., U.S. PTO Office Action, U.S. Appl. No. 11/008,230, Feb. 24, 2006, 11 pgs.
Y. Terao et al., U.S. PTO Office Action, U.S. Appl. No. 11/008,251, Jan. 13, 2006, 11 pages.
Y. Terao et al., U.S. PTO Office Action, U.S. Appl. No. 11/008,224, Dec. 14, 2007, 9 pgs.
C. Iixuka et al., U.S. PTO Office Action, U.S. Appl. No. 11/085, 251, Oct. 16, 2007, 10 pages.
Y. Terao et al., Notice of Allowance and Fee(s) Due, U.S. Appl. No. 11/085, 257, Oct. 31, 2007, 8 pages.
Y. Terao et al., U.S. PTO Office Action, U.S. Appl. No. 11/085, 250, Nov. 20, 2007, 13 pages.
Y. Terao et al., U.S. PTO Office Action, U.S. Appl. No. 11/085, 625, Nov. 2, 2007, 11 pages.

* cited by examiner

SHEET POST-PROCESS APPARATUS

CROSS-REFERENCE TO RELATED APPLICATIONS

This application is based upon and claims the benefit of priority from the prior Japanese Patent Applications No. 2004-285352, filed on 29 Sep. 2004 and No. 2004-366523, filed on 17 Dec. 2004, the entire contents of which are incorporated herein by reference.

BACKGROUND OF THE INVENTION

1. Field of the Invention

The present invention relates to a sheet post-process apparatus for post-processing sheets of paper ejected from an image forming apparatus such as a copier, a printer, or a composite device.

2. Description of the Related Art

In recent years, in an image forming apparatus, to post-process sheets of paper after image forming such as sorting or stapling sheets of paper, a sheet post-process apparatus may be installed in the neighborhood of the paper ejection unit of the image forming apparatus body. In such a sheet post-process apparatus, after waiting for ending of the sheet post-process of preceding sheets, the post-process of succeeding sheets is performed. To make the succeeding sheets ejected from the image forming apparatus body stand by like this, conventionally, a shifting path such as a standby tray may be installed halfway the path toward the stapling unit (for example, Japanese Patent Application 2004-155551).

When there are sheets of paper requiring no post process, from the viewpoint of maintaining the productivity of the image forming apparatus, a dedicated path of non-post-process sheets of paper is installed or non-post-process sheets of paper are ejected via the processing tray. Therefore, installation of a dedicated path causes an increase in cost and ejection of sheets of paper via the processing tray takes time.

DETAILED DESCRIPTION OF THE INVENTION

Throughout this description, the embodiments and examples shown should be considered as exemplars, rather than limitations on the apparatus and methods of the present invention.

Hereinafter, the embodiment of the present invention will be explained in detail with reference to the accompanying drawings.

Figure 1:
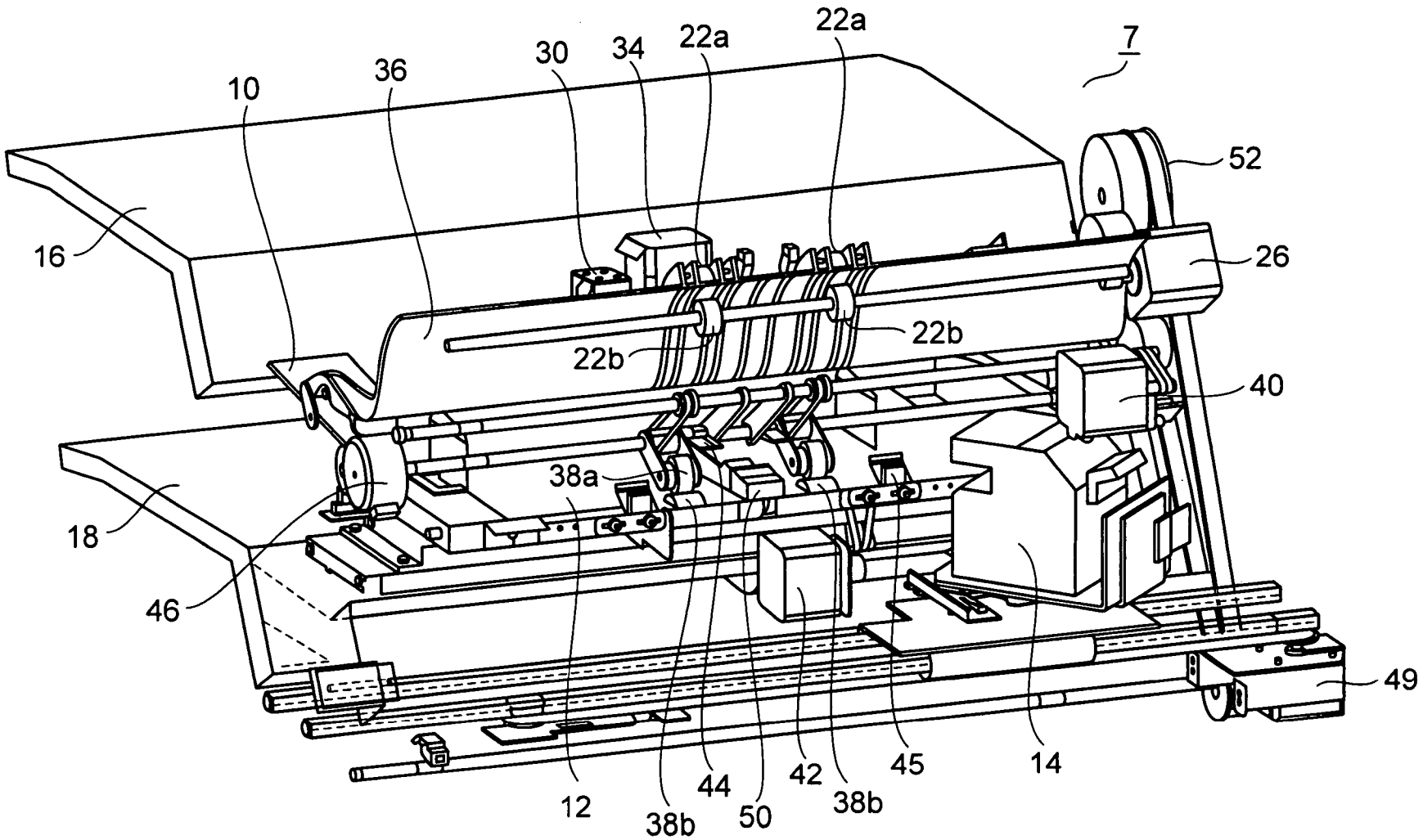
FIG. 1 is a perspective view showing the essential section of the sheet post-process apparatus relating to an embodiment of the present invention.
Figure 2:
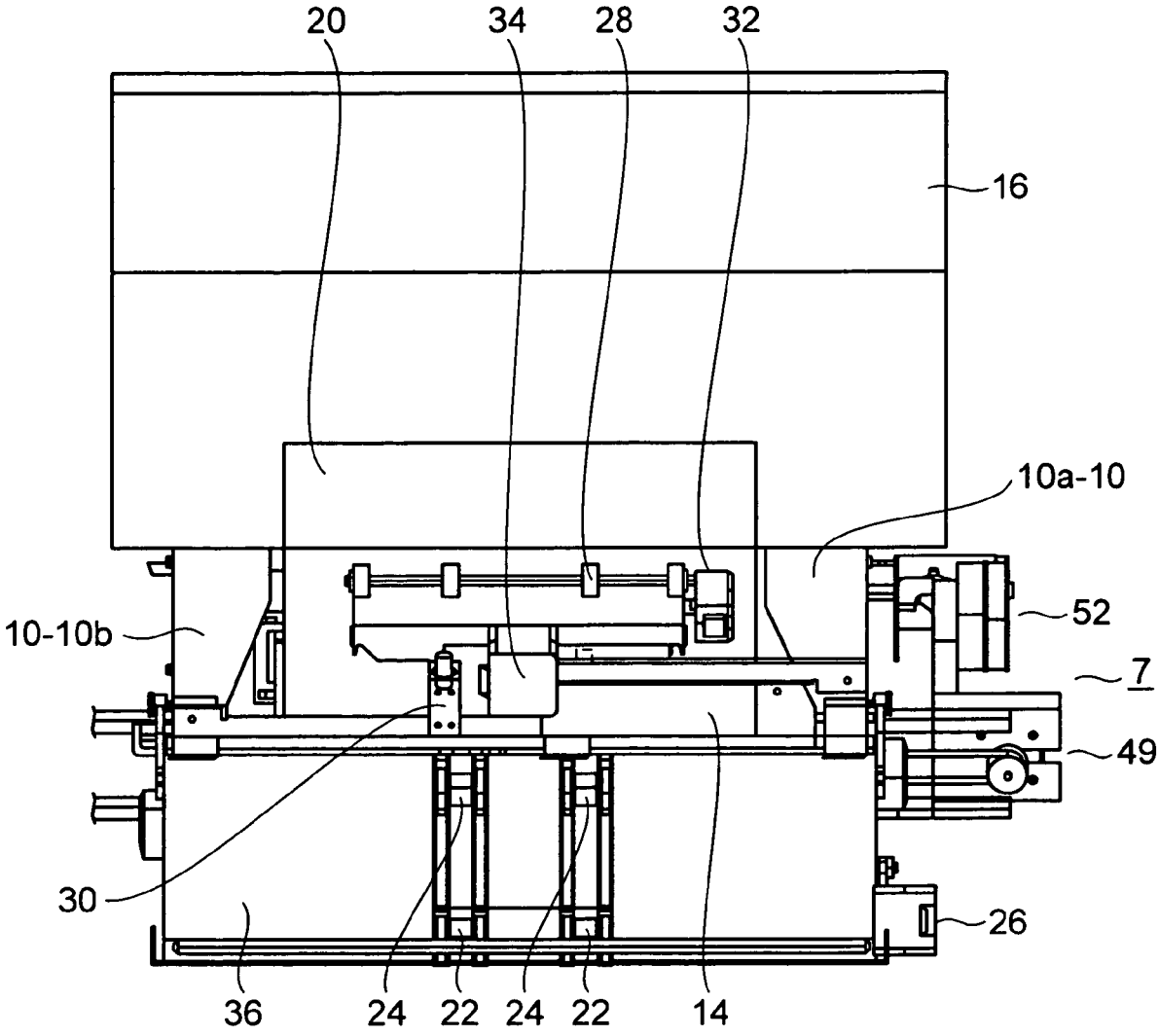
FIG. 2 is a top view showing the essential section of the sheet post-process apparatus relating to an embodiment of the present invention.
Figure 3:
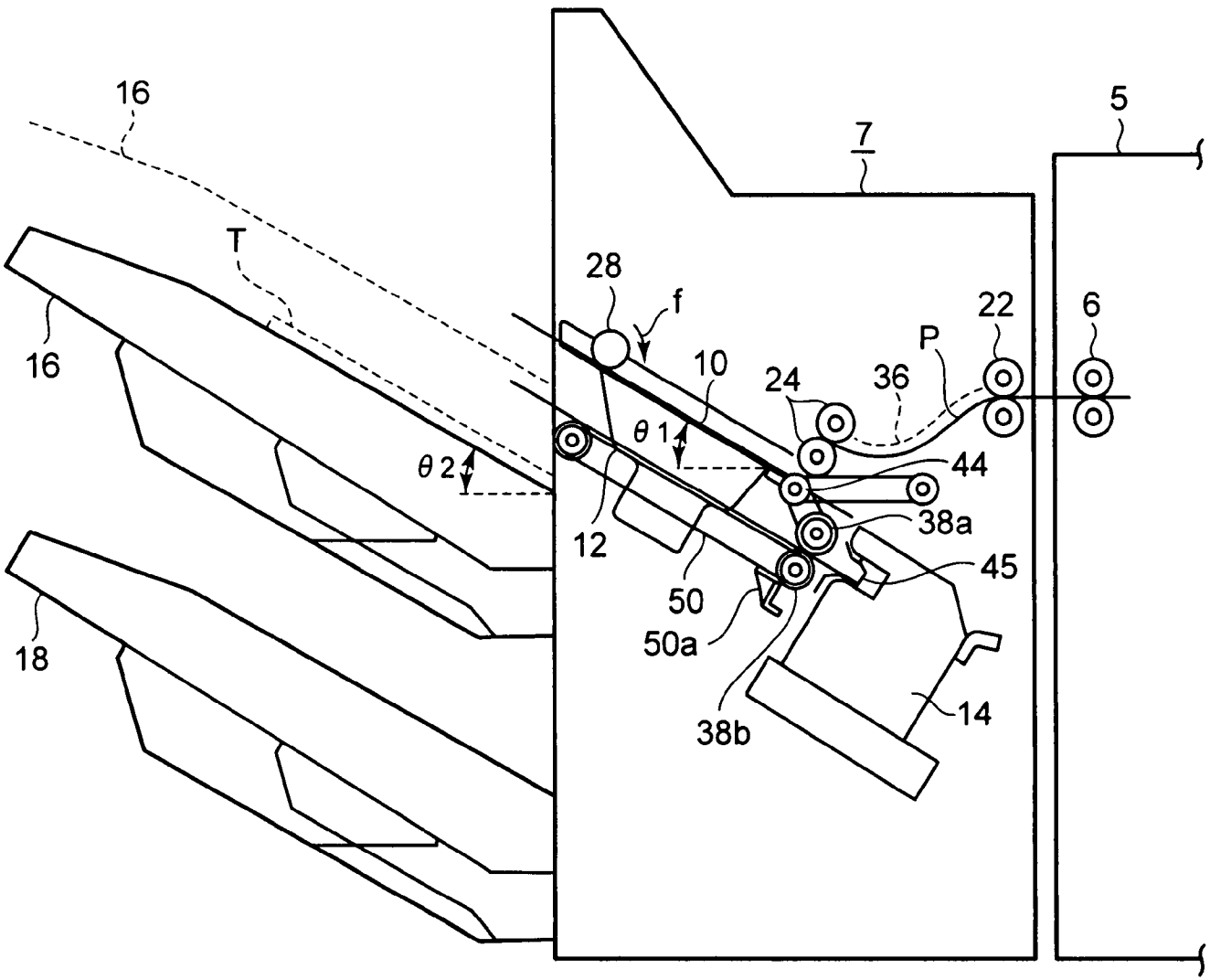
FIG. 3 is a schematic block diagram showing the sheet post-process apparatus relating to an embodiment of the present invention.

Further, to the same parts shown in the drawings, the same numerals are assigned and duplicated explanation will be omitted. FIG. 1 is a perspective view showing the essential section of a sheet post-process apparatus 7 relating to an embodiment of the present invention, and FIG. 2 is a top view of the essential section of the sheet post-process apparatus relating to an embodiment of the present invention, and FIG. 3 is a schematic block diagram showing the sheet post-process apparatus 7 arranged in the neighborhood of an image forming apparatus 5 such as a copier.

The sheet post-process apparatus 7 is basically composed of a standby tray 10, a processing tray 12, a stapler 14, a first paper ejection tray 16, and a second paper ejection tray 18.

A sheet of paper P on which an image is formed by the image forming apparatus 5 such as a copier and which is ejected by a pair of paper ejection rollers 6 is received by a pair of entrance rollers 22, is fed to a pair of paper feed rollers 24, and is sent to the standby tray 10 from the paper feed rollers 24. The entrance rollers 22 are driven by an entrance roller motor 26. Between the entrance rollers 22 and the standby tray 10, a paper path ceiling 36 for leading the paper P to the paper feed rollers 24 is installed. The entrance rollers 22 are composed of an upper entrance roller 22*a* and a lower entrance roller 22*b*. The paper feed rollers 24 are also composed of an upper paper feed roller and a lower paper feed roller.

Under the standby tray 10, the processing tray 12 for loading the sheets of paper P dropped and fed from the standby tray 10 is arranged.

The processing tray 12, while the sheets of paper P are stapled by the stapler 14 which is a processing mechanism for performing the post-process, matches and supports the sheets of paper P to be loaded.

Figure 7:
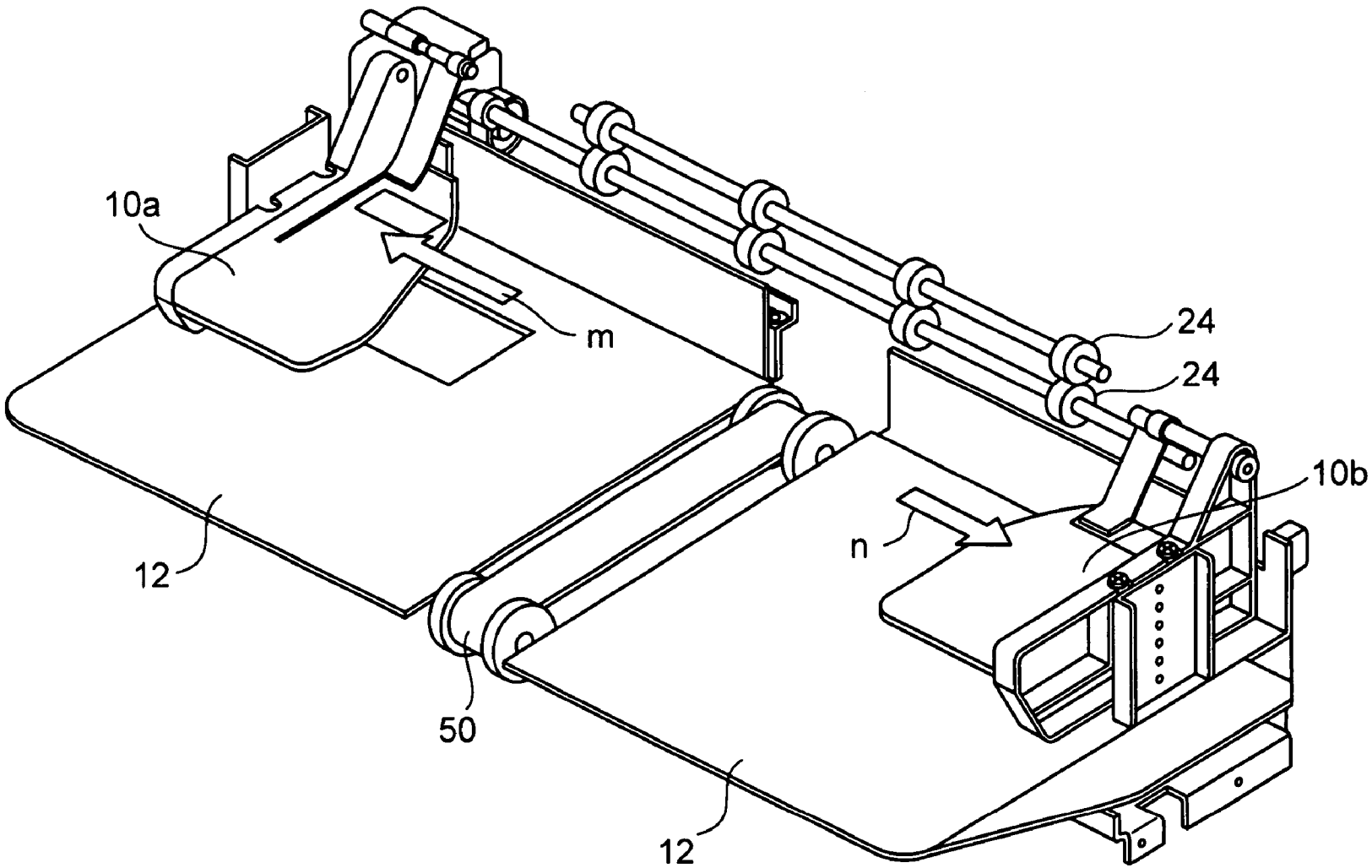
FIG. 7 is a schematic perspective view showing the standby tray and processing tray relating to an embodiment of the present invention.

As shown in FIG. 7, when a predetermined number of sheets of paper is accumulated on the standby tray 10, standby tray parts 10*a* and 10*b* are opened left and right on the drawing by a standby tray motor 34 and the sheets of paper P are dropped by their own weight on the processing tray 12.

Figure 4:
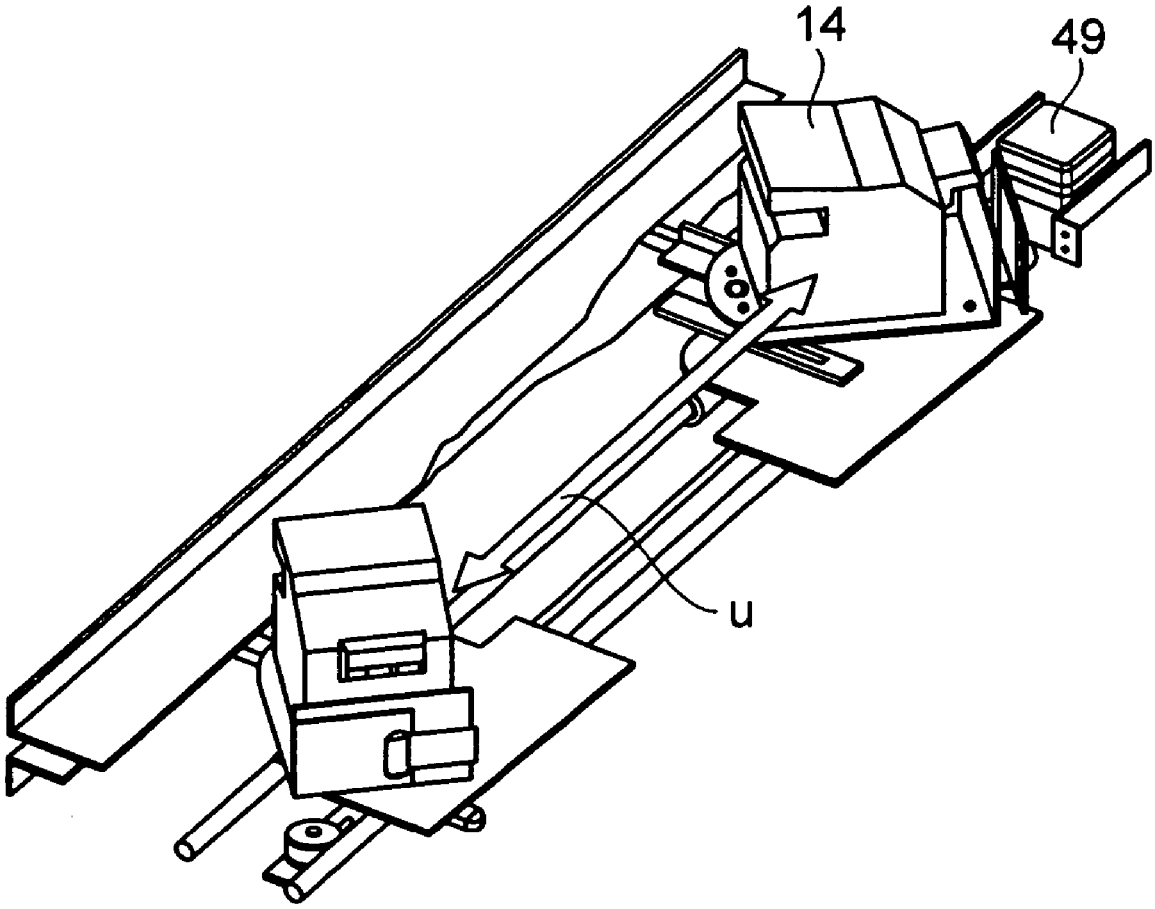
FIG. 4 is a perspective view showing the stapler of the sheet post-process apparatus relating to an embodiment of the present invention.
Figure 5:
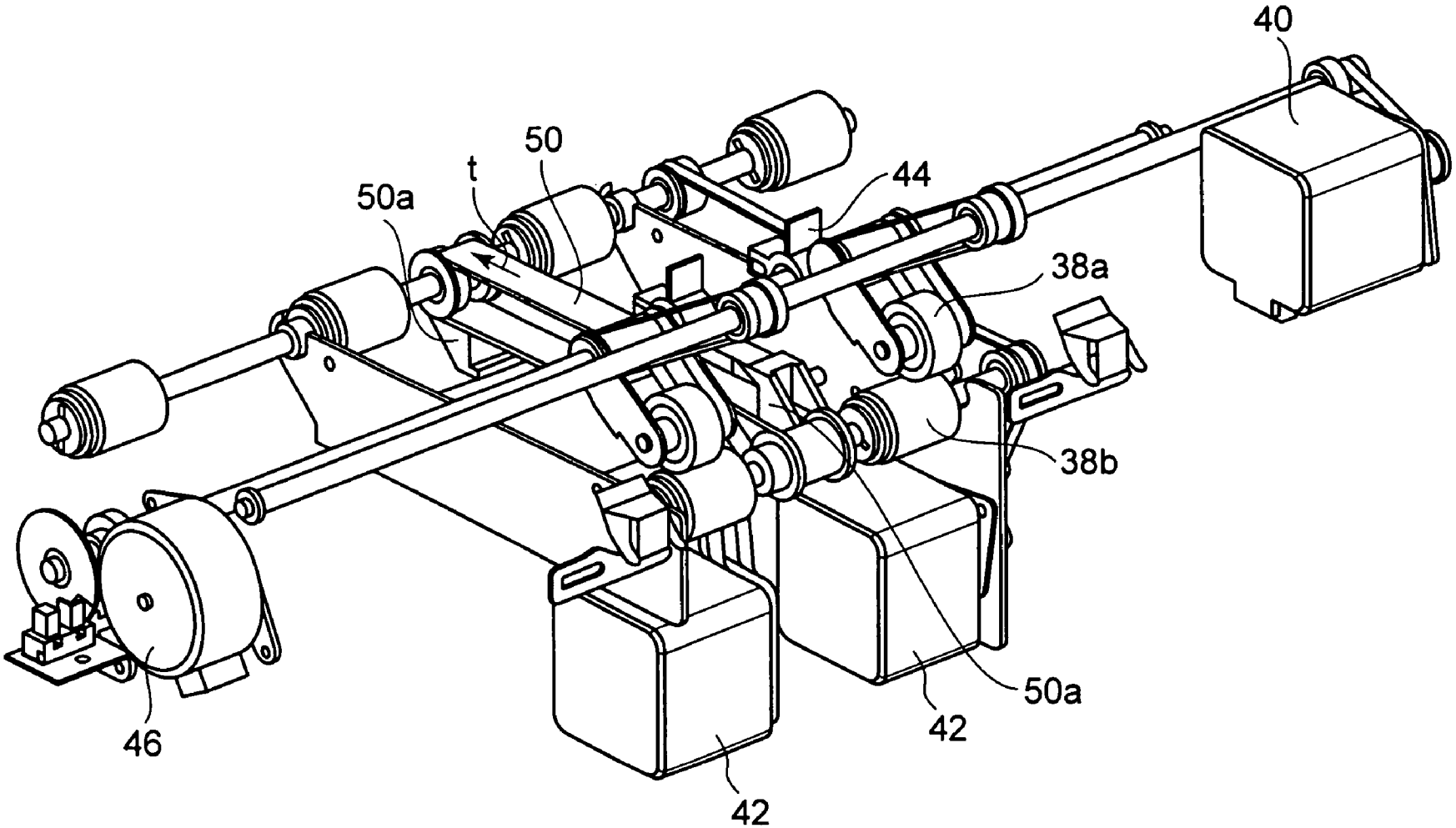
FIG. 5 is a perspective view showing the vertical matching roller relating to an embodiment of the present invention.

As shown in FIG. 4, the stapler 14 is positioned by a stapler driving unit 49 and the stapling process is controlled. The processing tray 12 has a pair of upper vertical matching roller 38*a* and lower vertical roller 38*b* for matching a plurality of sheets of paper P dropped and fed from the standby tray 10 in the vertical direction which is a conveying direction (refer to FIG. 5). The upper and lower vertical matching rollers 38*a* and 38*b* serve as bundle conveying rollers for holding a paper bundle T after stapled and taking out it from the stapler 14. The upper vertical matching roller 38*a* is driven by a vertical matching upper roller motor 40.

The lower vertical matching roller 38*b* is driven by a vertical matching lower roller motor 42.

Figure 6:
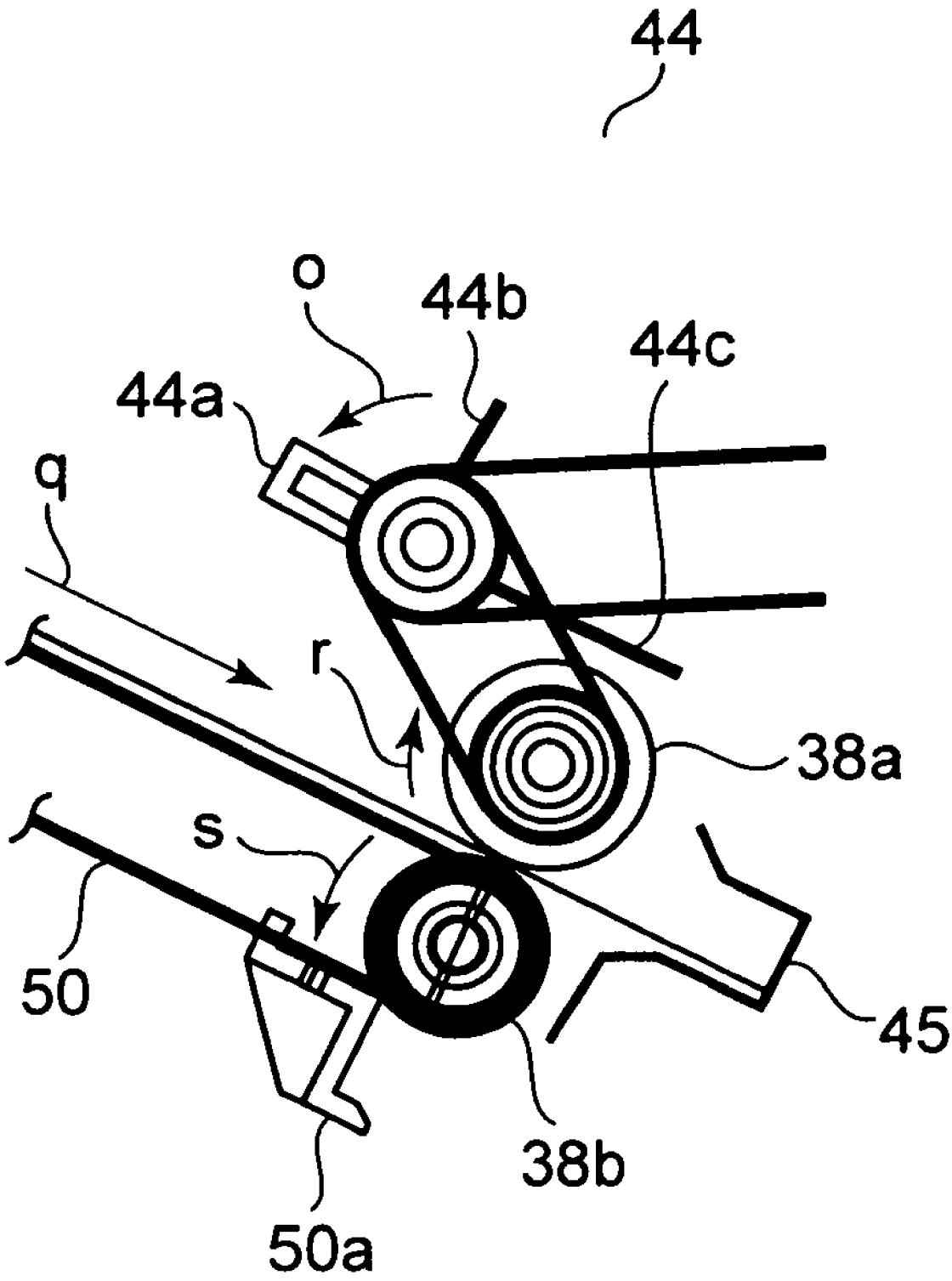
FIG. 6 is an illustration showing the paddle relating to an embodiment of the present invention.

When the sheets of paper P are dropped and fed on the processing tray 12, at the position where the rear end of each of the sheets of paper P is dropped, a rotatable paddle 44 for matching vertically the uppermost sheet of paper P loaded on the processing tray 12 is arranged. The paddle 44, as shown in FIG. 6, has a receiving portion 44*a* of the sheets of paper P dropped and fed onto the processing tray 12, a beating portion 44*b* for beating down the sheets of paper P on the processing tray 12, and a feeding portion 44*c* for matching the sheets of paper P on the processing tray 12 and it is driven by a paddle motor 46. The paddle 44 is composed of an elastic rubber material.

At the end of the processing tray 12 on the side of the stapler 14, a stopper 45 for making contact with the rear end of each of the sheets of paper P and controlling the rear end position. Almost at the center of the processing tray 12, a conveyor belt 50 for conveying the paper bundle T, which is stapled and taken out from the stapler 14 by the upper and lower vertical matching rollers 38*a* and 38*b*, up to the first or second paper ejection tray 16 or 18 is installed. To the conveyer belt 50, a feed pawl 50*a* for hooking the rear end of the paper bundle T is attached.

The standby tray 10 can drop and feed the sheets of paper P onto the processing tray 12 and also can convey the sheets of paper P toward the first or second paper ejection tray 16 or 18. When conveying the sheets of paper P toward the paper ejection trays 16 and 18, a standby tray roller 28 for matching the sheets of paper P makes contact with the sheets of paper P on the standby tray 10.

As shown in FIG. 3, the standby tray roller 28 is arranged, for example, on the standby tray 10, and in addition to the operation of making contact with the sheets of paper P loaded on the standby tray 10 and matching, it makes contact with the sheets of paper P loaded on the standby tray 10 and performs the operation of conveying them toward the paper ejection tray. And, the standby tray roller 28, when dropping the sheets of paper loaded on the standby tray 10 onto the processing tray 12, is shifted upward. Since the standby tray roller 28 is installed, it can eject sheets of paper requiring no post process directly to the paper ejection tray 16 without installing a dedicated path or not via the processing tray 12. Furthermore, even when performing the post process, a secondary effect of suppressing curling of the sheets of paper P loaded on the standby tray 10 can be produced.

The standby tray 10 supports the sheets of paper P so as to position the front ends thereof higher than the rear ends thereof, so that it is arranged at a tilt angle of θ 1. The first or second paper ejection tray 16 or 18 is moved up and down by a paper ejection tray driving unit 52 and either of them is selected. The first or second paper ejection tray 16 or 18 is moved up and down up to almost the same height as that of the standby tray 10 or the processing tray 12 when loading the sheets of paper P to improve the consistency of the sheets of paper P to be ejected. The first or second paper ejection tray 16 or 18 supports the sheets of paper P so as to position the front ends thereof higher than the rear ends thereof, so that they are arranged at a tilt angle of θ 2.

Figure 8:
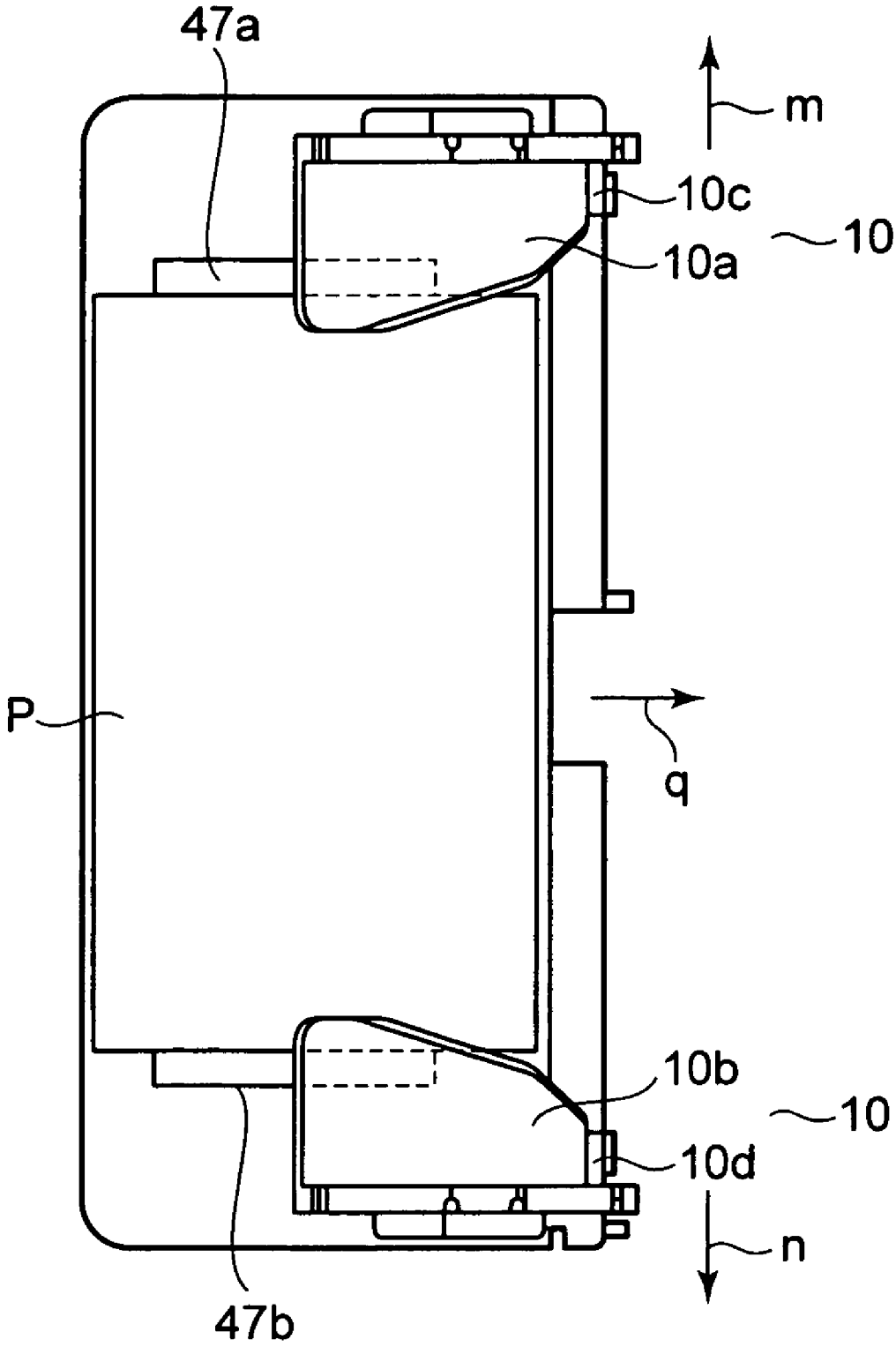
FIG. 8 is a top view showing the standby tray and processing tray relating to an embodiment of the present invention.

As shown in FIGS. 7 and 8, the standby tray 10 has a pair of tray members 10*a* and 10*b* formed so as to project from the wall face thereof, receives the sheets in a state that it slides in the width of the paper P and supports both sides of the paper P. On the tray members 10*a* and 10*b*, standby stoppers 10*c* and 10*d* for controlling the rear ends of the sheets of paper P are installed.

Figure 9:
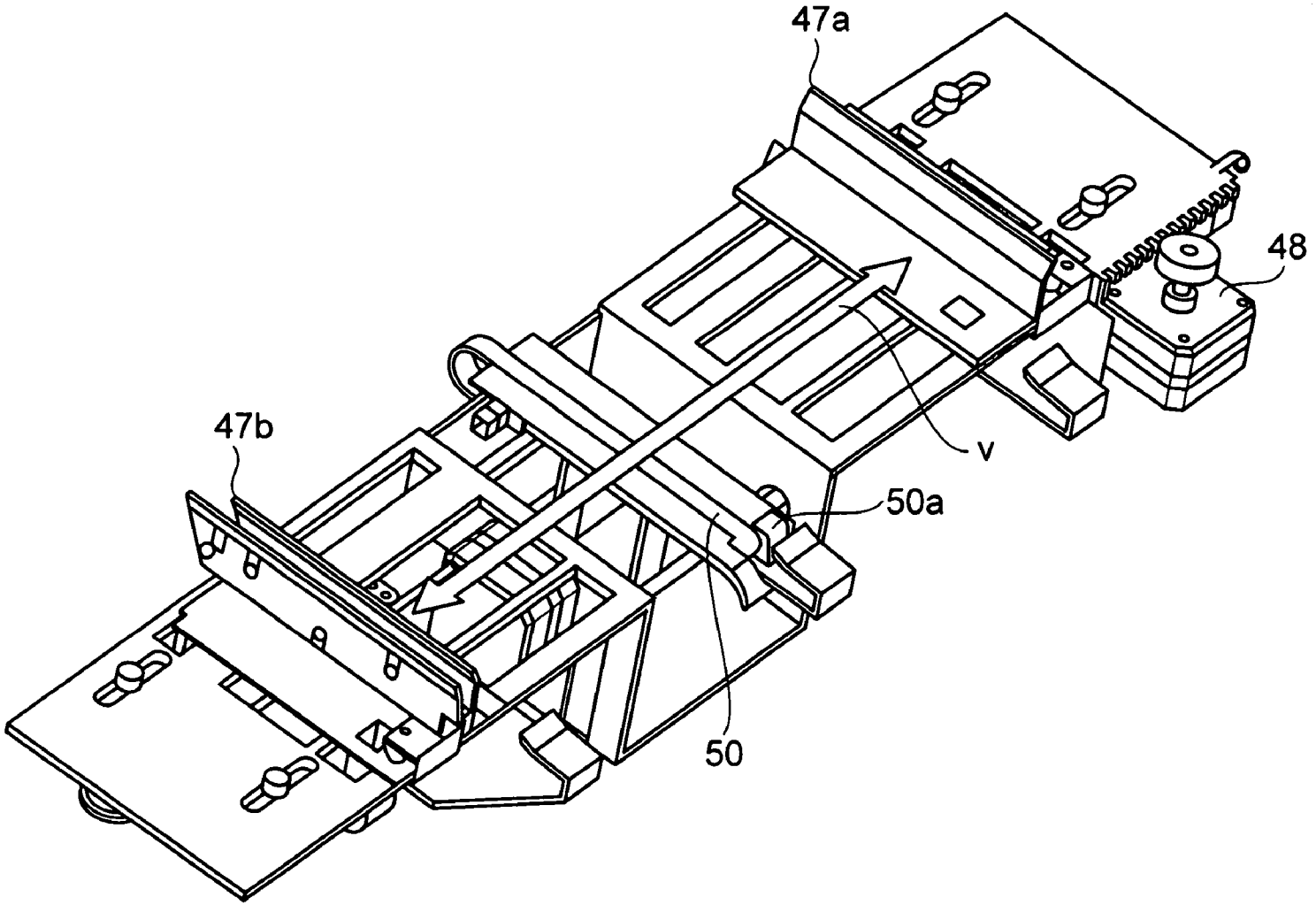
FIG. 9 is a schematic perspective view showing the horizontal matching plate and conveyor belt relating to an embodiment of the present invention.

The standby tray 10 slides and moves by the standby tray motor 34. Between the standby tray 10 and the processing tray 12 where it reaches, when dropping and feeding the sheets of paper P from the standby tray 10 onto the processing tray 12, horizontal matching plates 47*a* and 47*b* shown in FIG. 9 for preventing the sheets of paper P from turning away in the horizontal direction perpendicular to the conveying direction and matching them horizontally are installed. The horizontal matching plates 47*a* and 47*b* are formed slidably so as to fit to the width of the sheets of paper P by a horizontal matching motor 48.

Next, the operation of the invention will be described. When an image is formed by the image forming apparatus 5 and a sheet of paper P is fed from the paper ejection rollers 6, the sheet post-process apparatus 7, depending on a case of performing the post-process of the sheet of paper P or a case of performing no post-process, or while the preceding sheet of paper P is in execution of the post-process or the post-process is finished, performs a different operation.

When the post-process is not to be performed, for example, the first paper ejection tray 16 slides and moves to the position indicated by a dotted line shown in FIG. 3 and can load the sheets of paper P ejected from the standby tray 10 in good consistency. When the post-process is not to be performed, the sheet of paper 10 conveyed from the entrance rollers 22 to the paper feed rollers 24 via the paper path ceiling 36 is fed to the standby tray 10 by the paper feed rollers 24. Then, the sheet of paper P is moved down onto the standby tray 10, is conveyed by the standby tray 28 rotating in the direction of an arrow f, and is fed to the first paper ejection tray 16.

Figure 10:
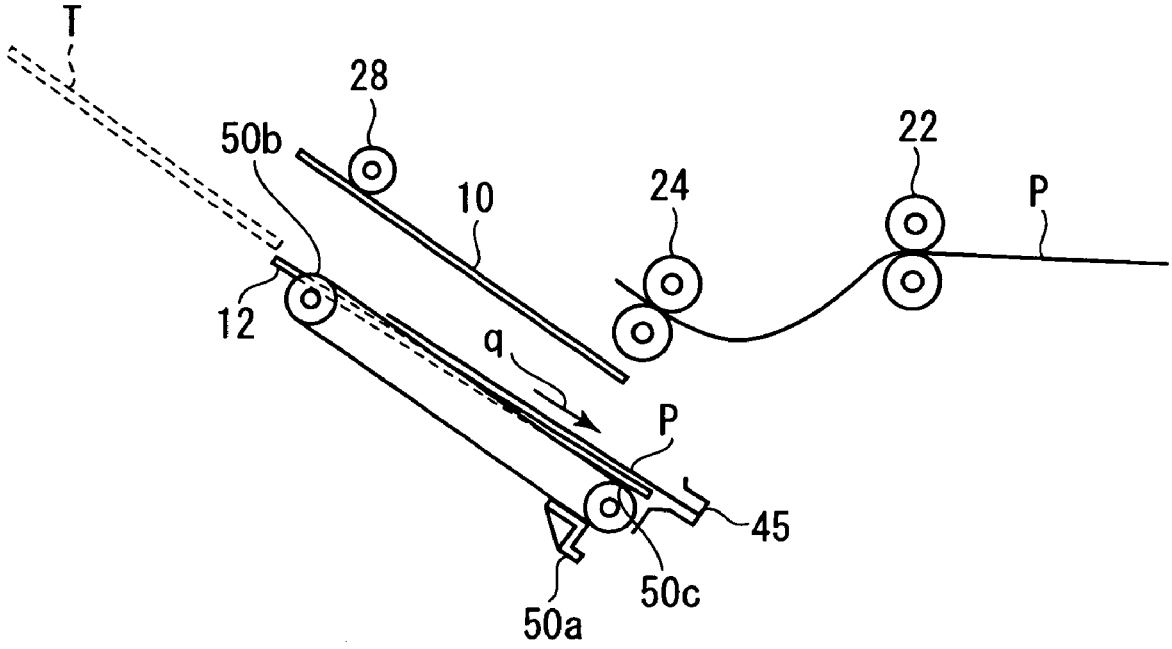
FIG. 10 is an illustration showing the state of pressed-out sheets on the standby tray or paper ejection tray relating to an embodiment of the present invention.

In this way, on the first paper ejection tray 16, sheets of paper are sequentially loaded. The first paper ejection tray 16 is arranged at a tilt angle of θ 2 and the front end of the sheet of paper is positioned higher than the rear end thereof, so that for example, even if the sheet of paper P is fed to the first paper ejection tray 16 in a state that it is curled convexly as shown by a dotted line in FIG. 10, the preceding sheet of paper P loaded on the first paper ejection tray 16 is not pressed out by making contact with the front end of the succeeding sheet of paper P. Namely, the ejected sheet of paper P is sequentially loaded on the first paper ejection tray 16 unless the order is disturbed. Even if the preceding sheet of paper P is pressed by the succeeding sheet of paper P and is slightly displaced, since the tilt angle is θ 2, the sheet of paper P drops by its own weight and is loaded on the first paper ejection tray 16 with the rear end matched, and the ejection process of the sheet of paper is completed.

Next, a case that the stapling process which is a post-process is to be performed and no preceding sheet of paper P in execution of the stapling process exists on the processing tray 12 will be described. At this time, the standby tray 10 slides and moves the tray members 10*a* and 10*b* respectively up to the positions indicated by the dotted lines in FIG. 11 in the directions of arrows m and n and opens the dropping and feeding path of the sheet of paper P. The horizontal matching plates 47*a* and 47*b*, to match the sheet of paper P dropping from the paper feed rollers 24 in the horizontal direction, are arranged so that the gap between the horizontal matching plates 47*a* and 47*b* is made almost equal to the width of the sheet of paper P. By doing this, the sheet of paper P fed by the paper feed rollers 24, without the conveying being obstructed by the standby tray 10, is dropped and fed directly onto the processing tray 12.

At the time of dropping and feeding, the upper vertical matching roller 38*a* is shifted upward and the receiving portion 44*a* of the paddle 44 receives the rear end of the sheet of paper P. Both sides of the sheet of paper P drop in contact with the horizontal matching plates 47*a* and 47*b* and are matched in the horizontal direction. Then, the paddle 44 rotates in the direction of an arrow o, drops the rear end of the sheet of paper P from the receiving portion 44*a*, and beats down it onto the processing tray 12 by the beating portion 44*b*. Furthermore, the paddle 44 feeds the sheet of paper P in the direction of an arrow q by the feeding portion 44*c*, and the rear end of the sheet of paper P makes contact with the stopper 45, and the vertical matching of the sheet of paper P is completed. Further, the vertical matching of the sheet of paper P on the processing tray 12 may be executed by the upper vertical matching roller 38*a* by moving up and down each time.

In this way, the sheet of paper P on which an image is formed is loaded directly on the processing tray 12 from the paper feed rollers 24 while sequentially matching it in the horizontal direction and vertically direction. When the sheets of paper P reach a predetermined number, the stapler 14 staples the sheets of paper P on the processing tray 12 at a desired position and bundles them to form the paper bundle T. Hereafter, the upper vertical matching roller 38*a* is moved down onto the paper bundle and the paper bundle T is held between the upper vertical matching roller 38*a* rotating in the direction of the arrow r and the lower vertical matching roller 38*b* rotating in the direction of the arrow s and is conveyed toward the first paper ejection tray 16. When the rear end of the paper bundle T passes the upper and lower vertical matching rollers 38*a* and 38*b*, it is hooked by the feed pawl 50*a* of the conveyor belt 50 rotating in the direction of the arrow t and is sent onto the first paper ejection tray 16.

At this time, the first paper ejection tray 16 slides and moves from the position indicated by the dashed line in FIG. 3 to the position indicated by the solid line. The first paper ejection tray 16 is arranged at a tilt angle of θ 2 and the front end of the sheet of paper is positioned higher than the rear end thereof, so that the preceding sheet of paper P sent onto the first paper ejection tray 16 is not pressed out by making contact with the front end of the succeeding paper bundle T. Further, even if the preceding paper bundle T is slightly displaced by the succeeding sheet of paper P, since the tilt angle is θ 2, the paper bundle T drops by its own weight and is loaded on the first paper ejection tray 16 with the rear end matched, and the stapling process of the sheets of paper P is completed.

Next, a case that the stapling process which is a post-process is to be performed and preceding sheets of paper P in execution of the stapling process remain on the processing tray 12 will be described. At this time, the standby tray 10 slides and moves the tray members 10*a* and 10*b* from the position indicated by the dashed line in FIG. 11 respectively in the opposite direction of the direction of the arrow m or in the opposite direction of the direction of the arrow n, and is moved to the position indicated by the solid line shown in FIG. 11, and can support the sheet of paper P. The standby tray roller 28 is shifted above the standby tray not to disturb the sheets of paper P. The sheets of paper P ejected from the image forming apparatus 5 and fed by the paper feed rollers 24 are loaded once on the standby tray 10 to wait for the processing tray 12 to be free.

The sheets of paper P loaded on the standby tray 10 are moved down onto the standby tray 10, are sent toward the standby stoppers 10*c* and 10*d* by the standby tray roller 28 rotating in the opposite direction of the direction of the arrow f, and are vertically matched with the rear end of the sheets of paper P in contact with the standby stoppers 10*c* and 10*d*. Furthermore, the first paper ejection tray 16 is arranged at a tilt angle of θ 1 and the front end of the sheets of paper is positioned higher than the rear end thereof, so that the sheets of paper P are vertically matched by the own weight with the rear end thereof in contact with the standby stoppers 10*c* and 10*d*.

The standby tray 10 is arranged at a tilt angle of θ 1, so that for example, even if the sheet of paper P is fed from the paper feed rollers 24 in a state that it is curled convexly and is fed to the standby tray 10, the preceding sheet of paper P loaded on the standby tray 10 is not pressed out by making contact with the front end of the succeeding sheet of paper P. Namely, the fed sheet of paper P is sequentially loaded on the standby tray 10 unless the order is disturbed. Further, even if the preceding sheet of paper P is pressed by the succeeding sheet of paper P and is slightly displaced, since the tilt angle is θ 1, the sheet of paper P drops by its own weight down to the position where the rear end thereof makes contact with the standby stoppers 10*c* and 10*d* and is loaded on the standby tray 10 with the rear end matched.

Figure 11:
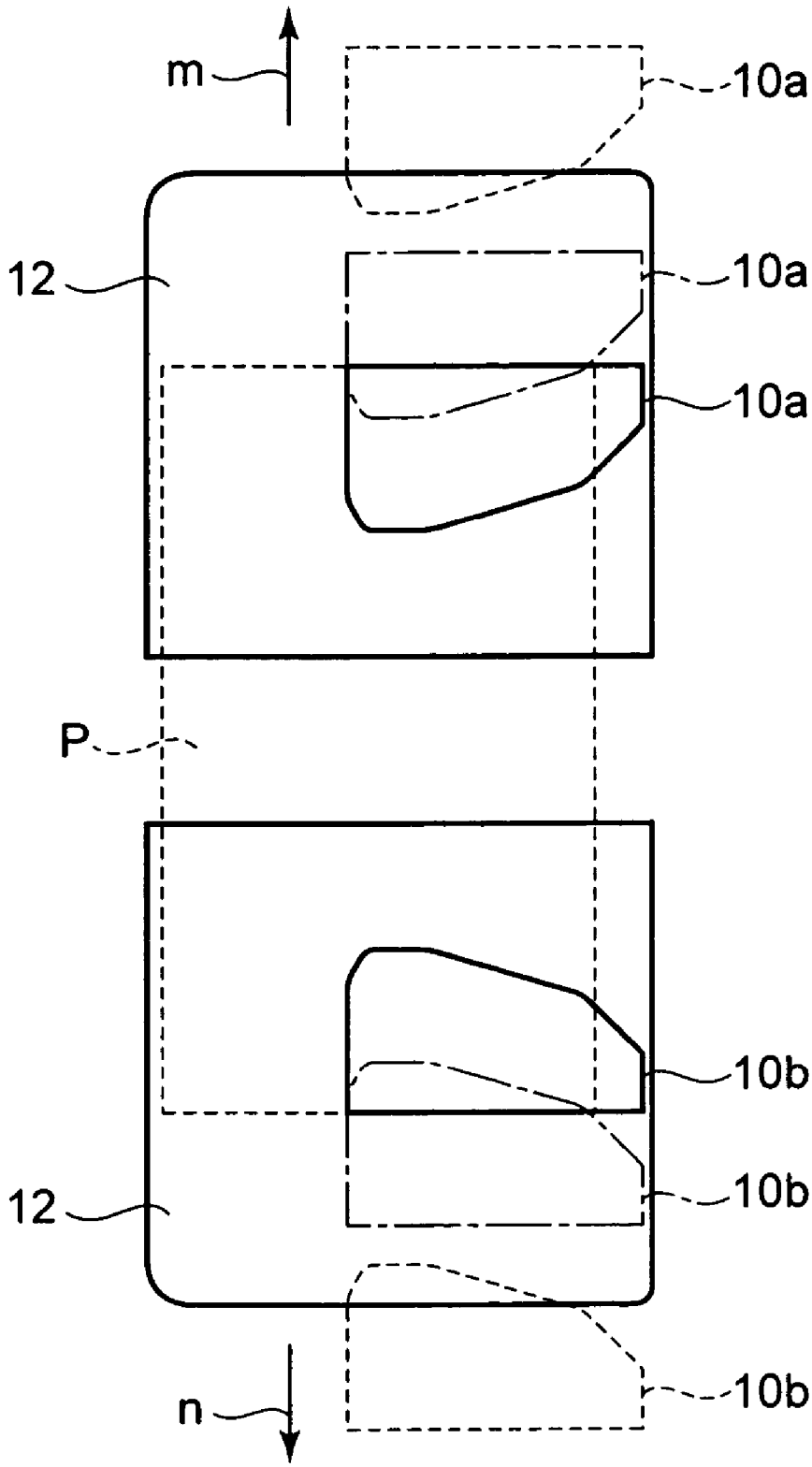
FIG. 11 is an illustration showing movement of the standby tray relating to an embodiment of the present invention.

During this period, when the preceding sheet of paper P on the processing tray 12 is ejected on the side of the paper ejection tray 16 and the processing tray 12 becomes free, the standby tray 10 slides and moves the tray members 10*a* and 10*b* respectively up to the positions indicated by the dotted lines in FIG. 11 in the directions of the arrows m and n from the position indicated by the solid line in FIG. 11 via the position indicated by the alternate long and short dash line in FIG. 11. By doing this, for example, two sheets of paper P standing by on the standby tray 10, when the tray members 10*a* and 10*b* reach the position indicated by the alternate long and short dash line in FIG. 11, are dropped and fed onto the processing tray 12 from between the tray members 10*a* and 10*b*. At this time, the horizontal matching plates 47*a* and 47*b* are arranged so as to make the interval between them almost equal to the width of the sheets of paper P. Therefore, the sheets of paper P dropped from the standby tray 10 are controlled on both sides by the horizontal matching plates 47*a* and 47*b* and are matched horizontally.

The lower side sheet of paper P of the two sheets of paper P dropped onto the processing tray 12 is sent in the direction of the arrow q by the lower vertical matching roller 38*b* rotating in the opposite direction of the direction of the arrow s, and the rear end of the sheet of paper P makes contact with the stopper 45, and the vertical matching of the sheet of paper P is completed. The upper side sheet of paper P of the two sheets of paper P dropped onto the processing tray 12 is sent in the direction of the arrow q by the upper vertical matching roller 38*a* rotating in the opposite direction of the direction of the arrow r, and the rear end of the sheet of paper P makes contact with the stopper 45, and the vertical matching of the sheet of paper P is completed, and thereafter, the upper vertical matching roller 38*a* is shifted upward.

The third and subsequent sheets of paper P ejected from the image forming apparatus 5 are directly dropped and fed onto the processing tray 12 from between the tray members 10*a* and 10*b* without standing by on the standby tray 10. Hereafter, the third and subsequent sheets of paper P are sequentially matched on the sheets of paper P loaded earlier on the processing tray 12 by the paddle 44.

When the sheets of paper P loaded on the processing tray 12 reach a predetermined number, the sheets are stapled by the stapler 14 to form a paper bundle T. Hereafter, the paper bundle T is conveyed toward the first paper ejection tray 16 by the upper and lower vertical matching rollers 38*a* and 38*b*, and furthermore the rear end thereof is hooked by the feed pawl 50*a* of the conveyor belt 50, and the paper bundle is sent to the first paper ejection tray 16, and the stapling process of the sheets of paper P is completed.

In this embodiment having such a constitution, there is no need to install a dedicated path of non-post-process sheets of paper, so that the cost of the sheet post-process apparatus can be decreased. Further, compared with paper ejection via the processing tray, the time up to paper ejection can be shortened.

Further, the standby tray 10 is given a tilt angle of θ 1, thus the sheets of paper P can be matched by the own weight on the standby tray 10. There is no fear that the sheet of paper P loaded earlier is pressed out by the succeeding sheet of paper P, and the consistency of the sheets of paper P on the standby tray 10 can be improved, and the sheets of paper P can be prevented from jamming, and the loading order of the sheets of paper P on the standby tray 10 can be prevented from disturbance. Similarly, the first or second paper ejection tray 16 or 18 is given a tilt angle of θ2, thus there is no fear that the sheets of paper P or the paper bundle T earlier loaded on the first or second paper ejection tray 16 or 18 is pressed out by the succeeding sheets of paper P or paper bundle T, and the consistency of the sheets of paper P on the first or second paper ejection tray 16 or 18 can be improved, and the sheets of paper P can be prevented from jamming, and furthermore the loading order of sheets of paper P or the paper bundle T on the first or second paper ejection tray 16 or 18 can be prevented from disturbance.

Further, in the present invention, as a post-process to be performed for sheets of paper loaded on the processing tray, the stapling process is described. However, the post-process is not limited to a case of stapling sheets of paper and for example, a post-process such as a hole-punching process in sheets of paper is not questionable. In this case, with respect to sheets of paper loaded on the processing tray, loading of one sheet instead of a plurality of sheets of paper provides no trouble. Needless to say, for a post-process apparatus having such a post-processing mechanism, the present invention produces an effect.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A Sheet post-process apparatus, comprising:

a standby tray configured to make sheets stand by, a processing tray arranged under said standby tray configured to load said sheets dropped and fed from said standby tray and supplied sheets not via said standby tray, a processing mechanism configured to post-process said sheets loaded on said processing tray, and a paper ejection tray configured to load said sheets ejected from said processing tray after ending of said post process, and a standby tray rotating body configured to perform a first operation matching said sheets loaded on said standby tray by rotating in a first direction, in contact with said sheets from an upper side of said standby tray and a second operation conveying said sheets loaded on said standby tray toward said paper ejection tray by rotating in a second direction different from the first direction, in contact with said sheets from the upper side of said standby tray, wherein the standby tray rotating body is lifted upward and placed at a distance from the standby tray when the sheets are supplied to the processing tray.

2. The sheet post-process apparatus of claim 1, wherein:

said standby tray rotating body, when dropping said sheets loaded on said standby tray onto said processing tray, performs a third operation shifting upward.

3. The sheet post-process apparatus of claim 1, wherein:

said standby tray rotating body can move vertically.

4. The sheet post-process apparatus of claim 1, wherein:

said standby tray rotating body is driven to rotate by a standby tray roller motor.

5. The sheet post-process apparatus of claim 1, wherein:

said standby tray has said standby tray rotating body.

6. A sheet post-processing method of a sheet post-process apparatus for post-processing sheets ejected from an image forming apparatus, comprising the steps of:

making said sheets stand by on a standby tray, loading said sheets fed from said standby tray and ejected from said image forming apparatus not via said standby tray on a processing tray, post-processing said sheets loaded on said processing tray, loading said sheets after ending of said post process on a paper ejection tray, and selecting a first operation matching said sheets loaded on said standby tray with a standby tray rotating body by rotating in a first direction, in contact with said sheets from an upper side of said standby tray and a second operation conveying said sheets loaded on said standby tray toward said paper ejection tray by rotating in a second direction different from the first direction, in contact with said sheets from the upper side of said standby tray, wherein the standby tray rotating body is lifted upward and placed at a distance from the standby tray when the sheets are supplied to the processing tray.

7. A sheet post-processing method according to claim 6, wherein:

when dropping said sheets loaded on said standby tray onto said processing tray, selecting a third operation shifting upward as one selection.

* * * * *